US005240327A

United States Patent [19]

Nyman et al.

[11] Patent Number: 5,240,327

[45] Date of Patent: Aug. 31, 1993

[54] METHOD FOR CREATING DOUBLE LOOP FLOW

[75] Inventors: Bror G. Nyman, Ulvila; Seppo S. Jounela, Pori; Launo L. Lilja, Pori; Valto J. Mäkitalo, Pori, all of Finland

[73] Assignee: Outokumpu Oy, Helsinki, Finland

[21] Appl. No.: 782,480

[22] Filed: Oct. 25, 1991

Related U.S. Application Data

[62] Division of Ser. No. 375,007, Jul. 13, 1989, Pat. No. 5,078,505.

[30] Foreign Application Priority Data

Oct. 21, 1987 [FI] Finland ..... 874.627

[51] Int. Cl.[5] ..... B01F 3/00

[52] U.S. Cl. ..... 366/302; 366/262; 366/263; 366/272

[58] Field of Search ..... 366/265, 262, 102, 307, 366/132, 285, 263, 292, 302

[56] References Cited

U.S. PATENT DOCUMENTS

| | | | |
|---|---|---|---|
| 1,764,498 | 6/1930 | Beers | 366/265 |
| 2,460,987 | 2/1949 | Kanhofer | 366/307 |
| 3,675,902 | 7/1972 | Marshall | 366/307 |
| 3,973,759 | 8/1976 | Mizrahi et al. | 366/264 |
| 4,483,624 | 11/1984 | Bacon, Jr. et al. | 366/307 |
| 4,548,765 | 10/1985 | Hultholm et al. | 366/102 |
| 4,799,862 | 1/1989 | Davidson et al. | 366/343 |

*Primary Examiner*—Harvey C. Hornsby
*Assistant Examiner*—Patrick F. Brison
*Attorney, Agent, or Firm*—Brooks Haidt Haffner & Delahunty

[57] ABSTRACT

The invention relates to a method for mixing liquids into each other or different phases into liquid by employing a double loop circulation, created below the surface zone of a reactor, in order to maintain an intensive mixing. It is characteristic of this Bottom Toroidal Roll or BTR principle that the employed mixer has a strong bottom draft and presses obliquely downwards, and that the mixer is installed according to the mixing method of this invention and that the flow pattern thereof is controlled in an exactly determined fashion. In our method the mixer jet hits the cylinder surface of the reactor, so that the jet is divided into two roughly equal parts by adjusting this distribution by means of a back-flow guiding member of the invention, which guiding member is located above the mixer. The rolling motion taking place in the reactor is controlled by means of specific baffles.

6 Claims, 5 Drawing Sheets

18
1
4
4
4
3
6
3
5
II
II
I
I
3
7
5
II
II
I
I
3
6
7
5
II
II
I
I
12
19

METHOD FOR CREATING DOUBLE LOOP FLOW

This is a division of application Ser. No. 07/375,007, filed Jul. 13, 1989, now U.S. Pat. No. 5,078,505.

The present invention relates to a method for mixing liquids together or mixing different phases into liquid by using the double loop flow created below the surface zone of the reactor in order to maintain intensive mixing. It is a characteristic feature of this "Bottom Toroidal Roll" or BTR principle that the employed mixer has a strong draft from beneath and presses obliquely downwards, and that the said mixer is installed according to the mixing method of this invention and its flow pattern is controlled in a strictly determined fashion. According to this method, the mixer jet hits the cylinder surface of the reactor, whereafter the jet is divided into two nearly equal parts, and the division is adjusted by means of a back-flow guiding member according to the invention, which guiding member is located above the mixer. The circular flow taking place within the reactor is controlled by means of special baffles.

Generally the reactor is mixed by applying the so-called backmixed principle, which means that all of the different phases are continuously mixed to each other. A typical feature of the mixer arrangement of the present invention is that the mixing space is divided into two zones. The zone below the back-flow guiding member is intensively mixed, whereas the zone above the back-flow guiding member is calmed down in a controlled manner. The flow pattern of the upper zone is adjusted in accordance with the corresponding flow pattern of the lower zone, as is explained in more detail below. When the mixing space is not mixed in a totally uniform fashion but is composed of two toroidal zones below the back-flow guiding member and of the pacified zone above the back-flow guiding member, it is possible to affect the delay time distribution of the material fed into the mixing space. The material fed close to the bottom of the reactor is seized along in the bottom toroid, wherefrom it is only gradually, against the rolling motion captured by the toroid, shifted into the upper toroid and correspondingly, when released therefrom, into the top space of the reactor. From a continuously run BTR reactor, the outlet is arranged as an overflow through the top space or from below the surface. In the latter case, the volume of the reactor contents is controlled by using a separate surface adjustment.

The BTR principle is viable in many fields of the process industry, where a mixing stronger than the normal backmixed type is needed in order to bring some degree of mixing or some chemical reaction nearer to the final state or to the equilibrium. By applying the principle of the present invention, it is possible to construct a number of reactors for various fields of technique. p Among the practical advantages achieved with the BTR principle, let us point out that the location of the mixing member can be arranged remarkably higher than in standard installations. Generally it is recommended that the diameter of the mixing member should be 0.33×the diameter of the reactor, and that the mixer is placed at a distance equal to its own diameter with respect to the bottom. While applying the BTR principle, these rules can be ignored and larger mixers employed, which mixers may have diameters of 0.33–0.50×the reactor diameter, and may be located at a distance of 0.5–1.5×the mixer diameter with respect to the bottom. According to this new dimensioning system, the drive shaft of the mixer becomes shorter, which brings about a remarkable advantage as for the strength of materials, when large reactors are constructed.

Another essential advantage is that the major part of the shaft power is distributed into the reactor space located below the back-flow guiding member. Thus the shaft power per volume is increased in the mixing zone of the reactor, without having to increase the total power demand of the reactor respectively. If the reactor contains some solid material in addition to the liquid, the fluidization of the solid material in the bottom part of the reactor is improved, and simultaneously the reactor bottom remains clean more easily. When employing the method of the present invention, the solid material in the bottom part is in better motion than in reactors with the backmixed mixing system. In addition to this, some degree of grinding is also brought about, when the solid particles collide in the counter-rotating toroids and when they are intensively mixed in the immediate vicinity of the mixer.

The classification which takes place in the mixing space can be controlled by adjusting the dimensions of the back-flow guiding member as well as by adjusting the distance between the back-flow guiding member and the reactor overflow. A continuously run BTR reactor can, owing to its classifying property, be used for instance for extending the treatment of a solid material, when the solid material has been collected in the reactor in a controlled fashion.

When employing a BTR reactor, the solids contents in the reactor can be maintained high, so that the liquid passes through the reactor with a delay shorter then that of the solid material, but everything proceeds as bottom feed via the toroid loops, without possibilities for shortcuts. This fact can be made use of when constructing for instance dissolution, precipitation or cementing reactors.

In general it is advantageous to use a BTR reactor in cases where the aim is to achieve an effective mixing of the liquid, and when it is important to treat all of the material fed into the reactor i a uniform fashion and to avoid inadequate treatment of any of the materials. One example of a case like this are the conditioning tanks used in the metallurgical industry, in which the chemicals needed in the next process stage, generally flotation, are mixed into ore slurry. Particularly in large conditioning tanks, where it is difficult to mix the whole content of the tanks in a uniform fashion according to the backmixed principle, it is advantageous to use a conditioning tank operated according to the backmixed principle.

The invention is described in more detail below with reference to the appended drawings, where FIG. 1 illustrates a vertical cross-section of the principle of the BTR reactor;

Figure 1:
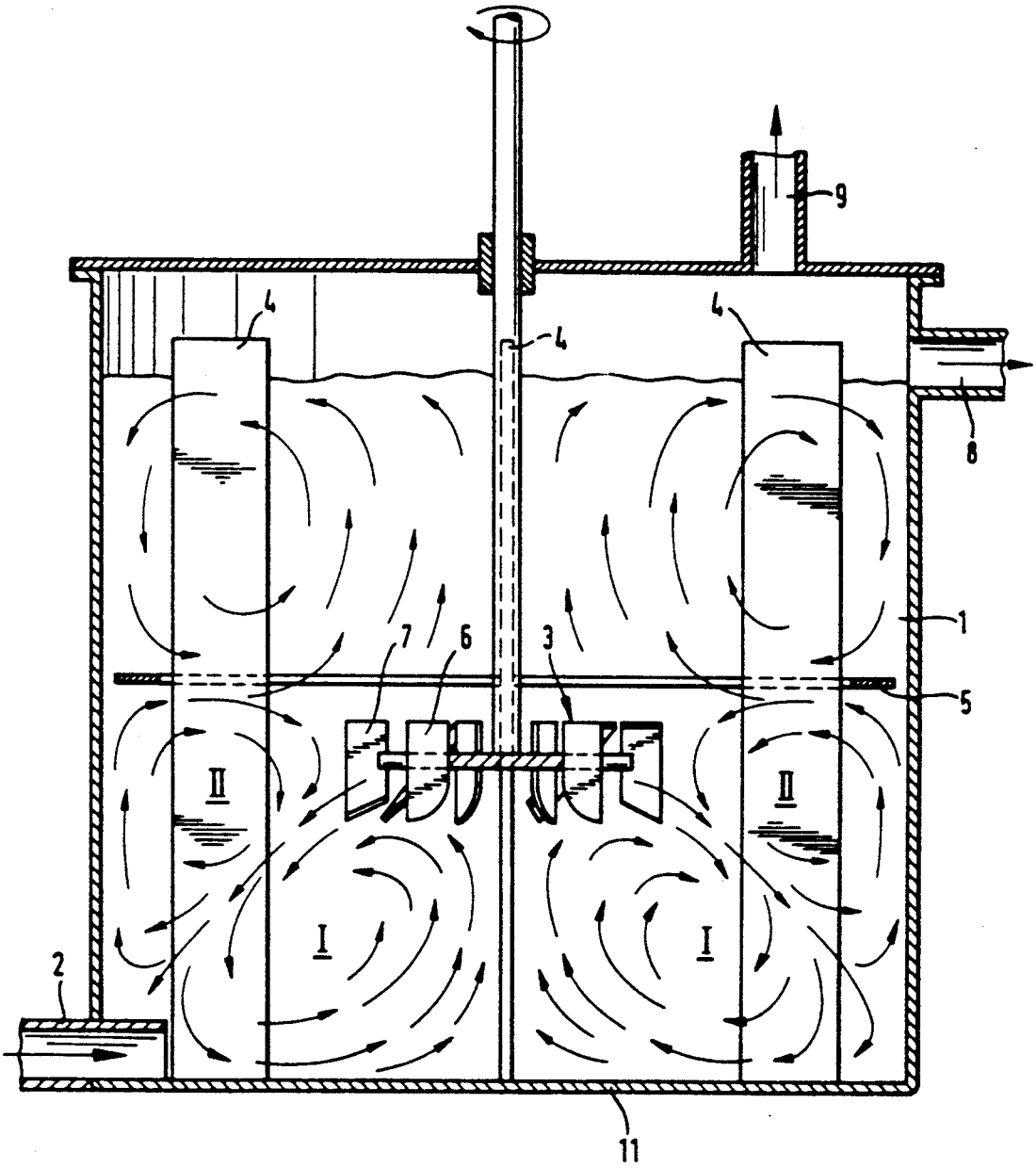

FIG. 1 shows that the BTR reactor of the invention is formed of a reactor 1 which advantageously has the form of a vertical cylinder. The material to be mixed is fed to the bottom space of the reactor via the supply conduit 2. In the BTR reactor it is advantageous to employ a heave mixing member 3 with a strong draft from beneath, which mixing member is installed at an exceptionally long distance from the bottom and has a large diameter.

The radial baffles 4 belonging to the BTR construction are broader than normal baffles. Their width is 0.10–0.15×the diameter of the reactor, when the width f normal baffles in standard arrangements is generally about 0.08×the reactor diameter and fluctuates within the area 0.05–0.10×the reactor diameter. A corresponding distance of the baffles from the cylinder surface is, according to standard settings, only 0.017×the reactor diameter. According to the present invention, the purpose of the baffles is to rectify the rotating movement of the material to be mixed in the reactor, and to maintain as much as possible of the motional energy of this material, wherefore an additional space, about ⅓ of the surface area of the reactor, is reserved for the flow in between the baffles and the cylinder surface of the wall. Thus the flow can proceed vigorously over the whole flow area, as far as the cylinder surface of the reactor. The number of baffles in BTR reactors is generally 2–8, advantageously 4.

The horizontal, circular back-flow guiding member 5 is installed, with respect to the altitude, above the mixer 3 but outside the baffles 4. In order to avoid dead regions, an aperture is left in between the outer surface of the backflow guiding member and the cylinder surface of the reactor, which aperture is at least as wide as the aperture of standard baffles, being usually 0.01–0.03×-the reactor diameter. The inner edge of the back-flow guiding member extends as far as the outer edge of the baffles at the most, but it is recommendable to leave some space in between the back-flow guiding member and the baffles. This space in turn is 0.04×the reactor diameter at the most.

An advantage of the BTR principle is the location of the back-flow guiding member near the mixer, in which case the double toroidal circulation is intensified while the mixing energy is distributed into the remarkably limited reactor space. The position of the back-flow guiding member, with respect to the mixer, can be adjusted; generally it is located at a distance of 0.05–0.20×the reactor diameter above the mixer, advantageously at a distance of 0.09×the reactor diameter above the mixer, and thus the rotational speed of the materials in the toroids is simultaneously adjusted.

As is apparent from the above specification, it is advantageous to provide the BTR construction with a heavy mixing member with a strong draft from beneath, which mixing member is installed at an exceptionally long distance from the bottom and has a large diameter. An example of this advantageous mixer type is the gls mixer described in the U.S. Pat. No. 4,548,765. The gls mixer of FIG. 2 has twelve blades. The straight inner blades 6 of the mixer create the required bottom draft, and the outer slanted blades 7 create an intensive mixing flow. The mixer is suited both for fluidizing solids according to the principle of the invention, and for dispersing gas into a liquid possibly containing solids. It is naturally clear that the mixer can be somewhat modified with respect to the described gls mixer.

Owing to the combined effect of the back-flow guiding member and the gls mixer, a double toroid is created in the reactor below the back-flow guiding member, which toroid is illustrated with arrows in FIG. 1. The liquid, or a mixture of liquid and solids, supplied through the supply conduit 2, rotates first in the lower bottom toroid 1 and is gradually shifted into the top toroid 11. From there the well-mixed suspension rises to the zone of a peaceful and controlled flow located above the back-flow guiding member, and the suspension is discharged therefrom as an overflow through the opening 8. If gas is discharged from the suspension, the gas outlet pipe 9 is placed in the reactor lid. The creation of double toroids and the peaceful zone has been experimentally verified.

Drastic modifications, such as changing over to a mixer provided with only slanted blades, are not applicable in connection with a BTR reactor, because it does not create bottom draft circulation, which is indispensable according to our exemplary experiments. Neither can a Rushton-type turbine operated with only straight blades be used, because this creates a horizontally proceeding mixer jet which weakens too much when colliding with the cylinder surface of the reactor. When employing this mixer, the upwards turning portion of the jet cannot be controlled by means of the back-flow guiding member located in the immediate vicinity of the mixer, but the mixer efficiency must be allowed to be distributed more or less over the whole reactor. As a consequence, strong bottom toroids which rotate in the opposite directions are not created as was the case when employing the gls mixer. A Rushton-type mixer constructed for dispersing is neither suitable for fluidizing solid materials, because this would require a remarkable increase in the shaft power. The gls mixer is a dispersing mixer which needs less shaft power than the Rushton-type mixer and functions as an effective fluidizer in the BTR mixing, thus creating a powerful double toroidal circulation. The essential point is that part of the primary jet proceeds along the bottom towards the center, where for instance the bottom design 10 of FIG. 4 can be employed in order to intensify the circulation.

In the above specification we have explained how the BTR principle is suited to be applied in liquid or slurry mixing operations, where it is important to ensure that all of the material fed into the reactor undergoes a uniform mixing treatment without a chance to make a shortcut through the reactor. As an example we have mentioned the conditioning tanks used in the treatment of ore slurry, where various chemicals to be mixed in the slurry are dosed.

Because a reactor according to the BTR structure includes a dispersing gls mixer, the BTR principle can be applied to the treatment of gas-containing liquids or slurries. The BTR-type reactors can be employed whenever a good contact between liquid and gas is required, or when the delay of gas bubbles in the reaction is desired to be extended. The fact is that the gas remains rolling in the toroids and is released only gradually when new gas is fed into the reactor. An intensive contact and an extended delay time increases the utilizing rate, i.e. the efficiency of the gas, when the gas participates in a chemical reaction or is absorbed into a liquid. A good example of the viability of the BTR principle is the flotation cell of FIG. 2. This has turned out to be efficient in separating concentrates from ore slurries especially in cases where an increase in the redox potential, owing to an effective air/slurry contact, improves flotation.

Figure 2:
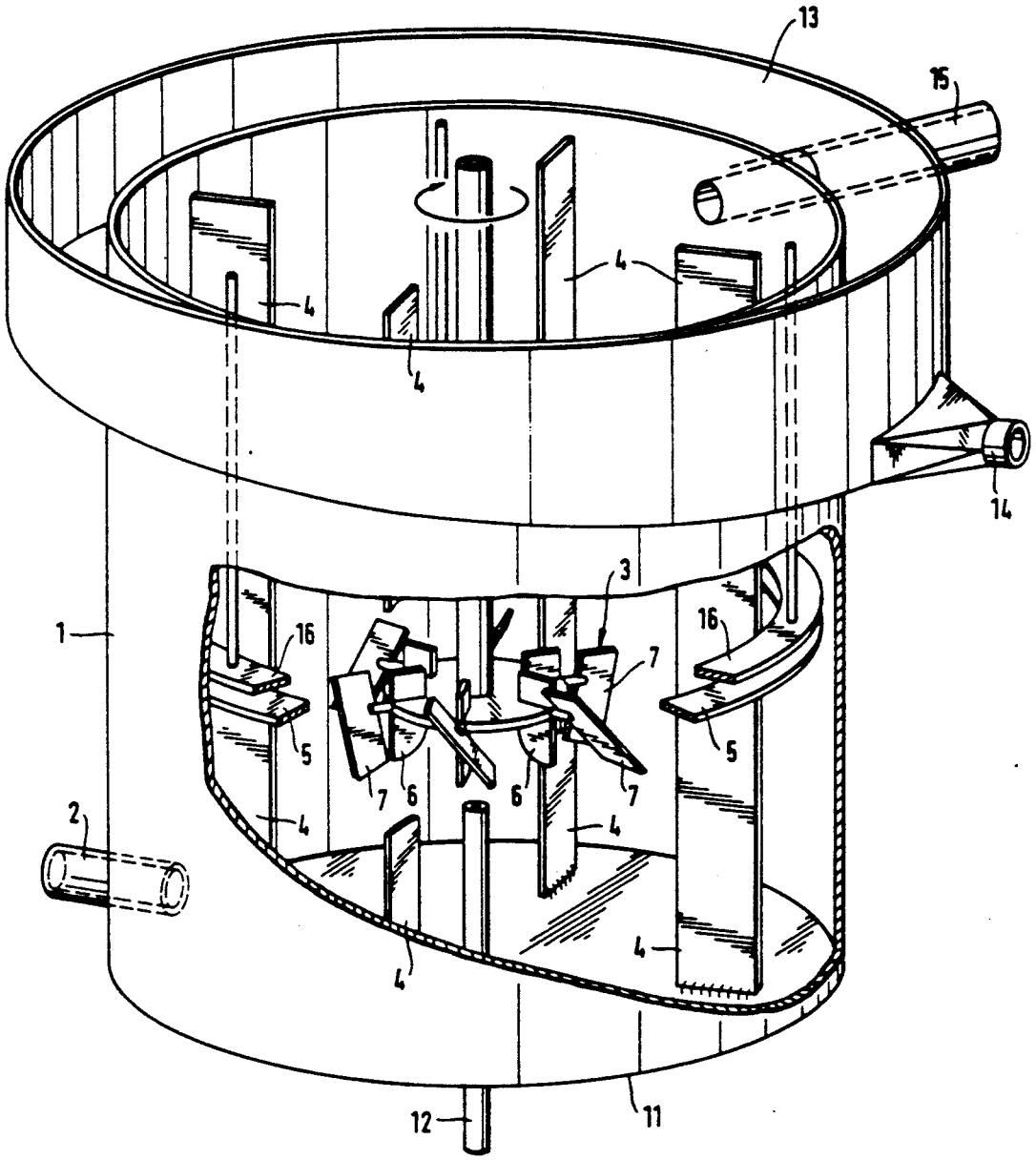
FIG. 2 illustrates a flotation cell operated according to the BTR principle, seen in a partial cross-section with an oblique axis.

FIG. 2 shows that the flotation cell of the invention is formed of the reactor 1. The ore slurry is fed into the bottom space of the reactor through a feed pipe. The feed pipe extends to the level of the outer edge of the baffle 4, where the ore slurry to be fed in is seized along in the bottom toroid, because the flow here is parallel to the inlet of the feed pipe. The bottom toroid is created by means of a mixer 3 with a strong bottom draft, the mixer being installed at such a distance from the bottom 11 that the mixer jet, which is directed obliquely downwards, hits the level of the cylinder surface of the flotation cell at a height located in between the bottom and a given height, i.e. half of the diameter of the mixer.

On the horizontal level, the bottom of the reactor is advantageously straight or bulged, in which case it is advantageous to stick to the so-called over so large a bottom volume that the toroidal circulation would become too weak.

An essential part of the flotation cell is the air-feeding conduit 12 which is placed vertically in the middle of the cell, below the mixer and in the immediate vicinity thereof. The horizontal, rotating mixer plate of the mixer distributes the supply air and the rest of the air rotating along the bottom toroid in every direction, to be dispersed by the straight inner blades 6 and the slanted outer blades 7 of the mixer. The air proceeds in bubbles along with the slurry jet created by the mixer, and is divided near the cell bottom, in the vicinity of the cylinder surface, into the bottom toroid and the top toroid. The size of the bubbles can be adjusted by changing the shaft power.

The influence area of the top toroid is upwards limited by the circular back-flow guiding member 5, which is installed above the mixer and outside the baffles. The purpose of the back-flow guiding member is to adjust the power of rotation of the top toroid. Thereby the distribution of air over the cross-sectional area of the cell and the rising of air into the top space of the cell can both be adjusted. Simultaneously the back-flow guiding member attenuates the motion created by the mixer in the top space of the reactor, thus improving the flotation separation. By employing the described back-flow guiding member provided with a circular aperture, the flow pattern in the flotation cell can in the middle be linked slowly upwards, and on the surface to flow outwards from the center. Thus the concentrate foam can be directed in an even flow to the concentrate trough 13 extending over the circumference of the whole cell and discharged therefrom through the outlet pipe 14. The waste is discharged through the pipe 15.

FIG. 2 also illustrates another back-flow guiding member, whereby the flow pattern in the top space of the flotation cell can be controlled. The nearer the top ring 16 of the guiding member is brought to the main ring 5, the more the flow is directed towards the center, and the slighter is the amount of air needed for intensifying the surface flow in the cell from the center outwards. At the same time the strength of the rising center flow can be increased, which is a way to affect the flotation separation. The gas delay time in the reactor can also be adjusted by means of the main ring 5 and the top ring 16 of the guiding member. The broader the main ring 5 is and the nearer to the main ring the top ring 16 is brought, the longer the gas remains rolling in the toroidal loops. Simultaneously the gas content of the reactor, with a given gas supply, increases.

Figure 3:
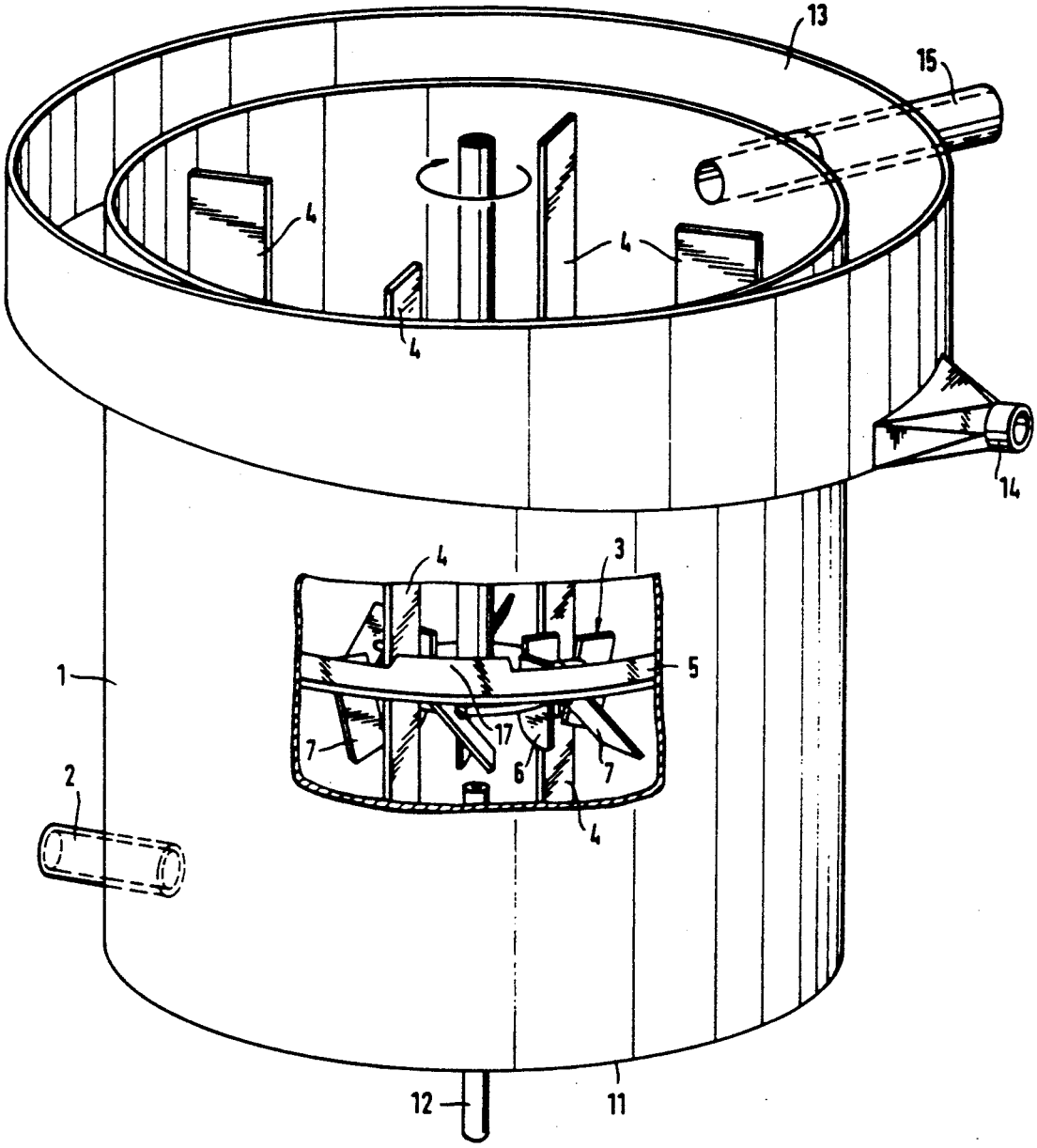
FIG. 3 illustrates a BTR reactor and an advantageous backflow guiding member thereof, seen in a partial, oblique cross-section.

FIG. 3 illustrates a modification of the main ring of the back-flow guiding member, the inner edge whereof is provided with an extension 17, in a sector of 10°–30°, next to the baffles 4, on that side of each baffle where the circulating flow caused by the rotation of the mixer collides and thus, after changing to a rising flow, increases the load on the back-flow guiding member.

A typical feature of the BTR reactor is strong circulation flows in the double toroids. In the flotation cell application, the strong toroids are utilized in the dispersion of air and in distributing air into the slurry. This is a deliberate way of avoiding any weakening in the mixing intensity, which is often caused by the stator structures arranged in the bottom of the cell, around the mixer. By means of the gls mixer, a sufficient dispersion of air is achieved in the BTR structure, the more so as the toroids rotating in opposite directions promote the dispersion. The flow baffles used in cells with a conventional structure too much hinder the mixing of the flow n the cell circumference, but the baffles of the present invention are located further from the circumference than the conventional flow baffles. The baffles we use are radially arranged and broader than any standard flow baffles.

The above structure has the advantage that the dispersion and distribution of air is carried out throughout the whole bottom space by means of the double loop flow, which makes it possible to determine the measures of even large flotation units, of 50–100 $m^3$, according to the BTR principle. The said principle is to dependent on any local dispersion of air in a given mixer/stator structure, wherefore it is particularly well suited for large flotation units. It is advantageous that the thickness of the slurry layer on the back-flow guiding member does not have to be increased in the same proportion as the other measures, which decreases the pressure demands for the flotation air.

Figure 4:
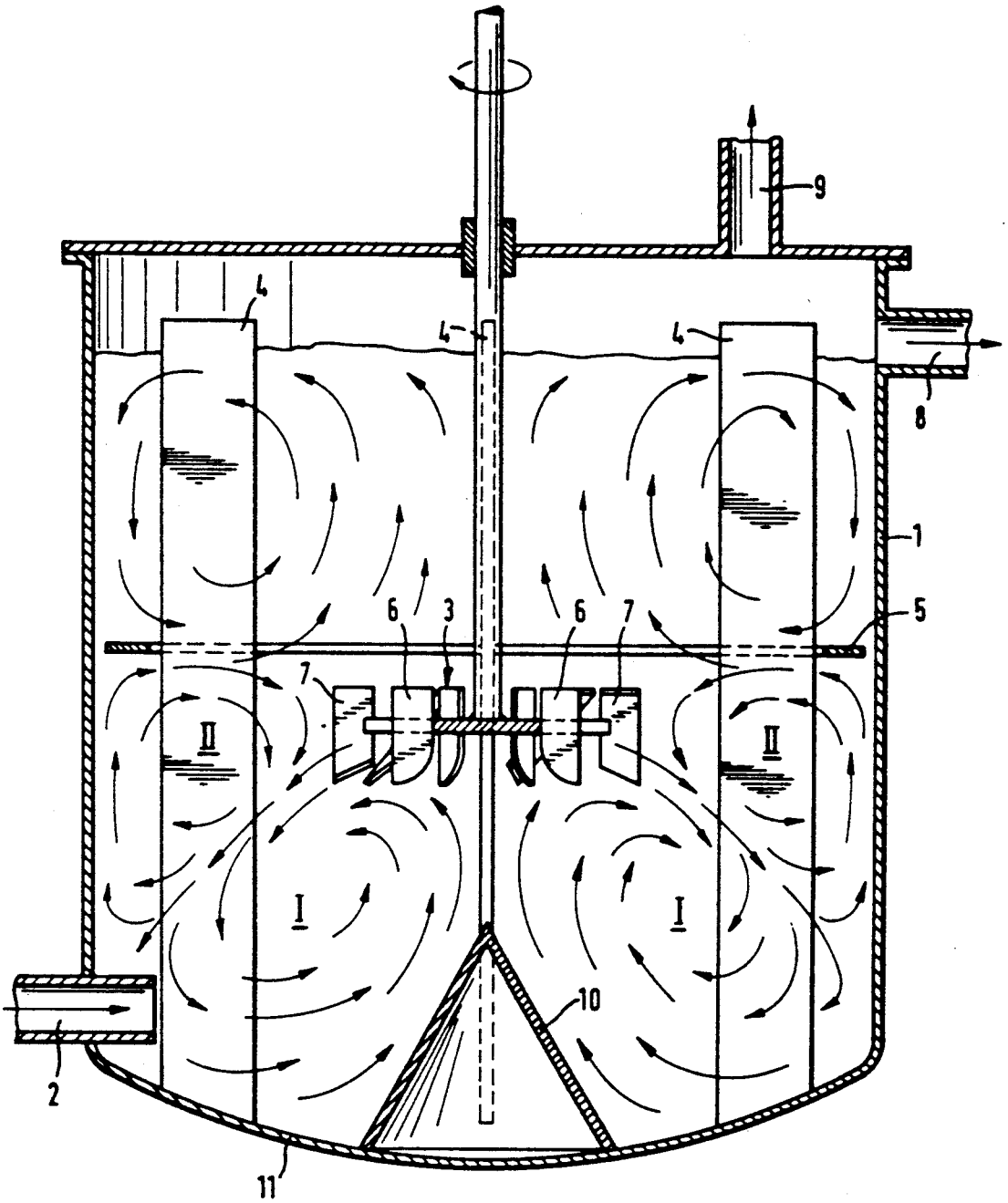
FIG. 4 is a vertical cross-section of a BTR reactor used as a gas reactor.

The same BTR structure as in the flotation cell can also be used in other reactors treating gas and liquid or gas and suspension in cases where a good contact between the gas and the rest of the reactor content is important, and when it is simultaneously desired to improve the efficiency of the gas utilization in order to promote a given chemical reaction or the dissolution of gas. FIG. 4 is an illustration of the principle of such a gas reactor. The way of feeding in liquid or suspension, and respectively gas, is similar to the one explained earlier in connection with the flotation cell. The structure and installation of the mixer, as well as the back-flow guiding member and the baffles, are similar to the ones described above. The form of the bottom can be either straight or, as the one in FIG. 4, bulged. In this case it is advantageous to use the bottom design 10 directing the bottom toroid.

In order to enlarge the flotation space, the top part of the reactor can be provided with a rim higher that the ones described above. Troughs are not generally used on the reactor circumference. In continuous run, the discharge from the reactor is arranged for example as an overflow 8. The discharge ca also take place from below the surface, by employing the outlet pipe provided in the cylinder surface belonging to the top space of the reactor. The reactor can also be used in batch processes, in which case both the feeding and the discharge can be carried out through the bottom space.

The above described reactor can be used for instance as an oxidizing reactor advantageously when the oxidizing gas is oxygen, ozone or chlorine. The reactor is well suited for cases where it is desired to absorb or dissolve gas into liquid or suspension. Then the gas can be carbon dioxide, chlorine, hydrogen sulphide or some other gas which dissolves in the liquid in question. The gas can also be a precipitating chemical reagent such as hydrogen sulphide or hydrogen. Respectively air, oxygen or chloride can be the gas participating the chemical dissolution process. Dissolution or reoxidization can also take place under pressure, in which case the BTR principle is realized according to the autoclave principle.

Figure 5:
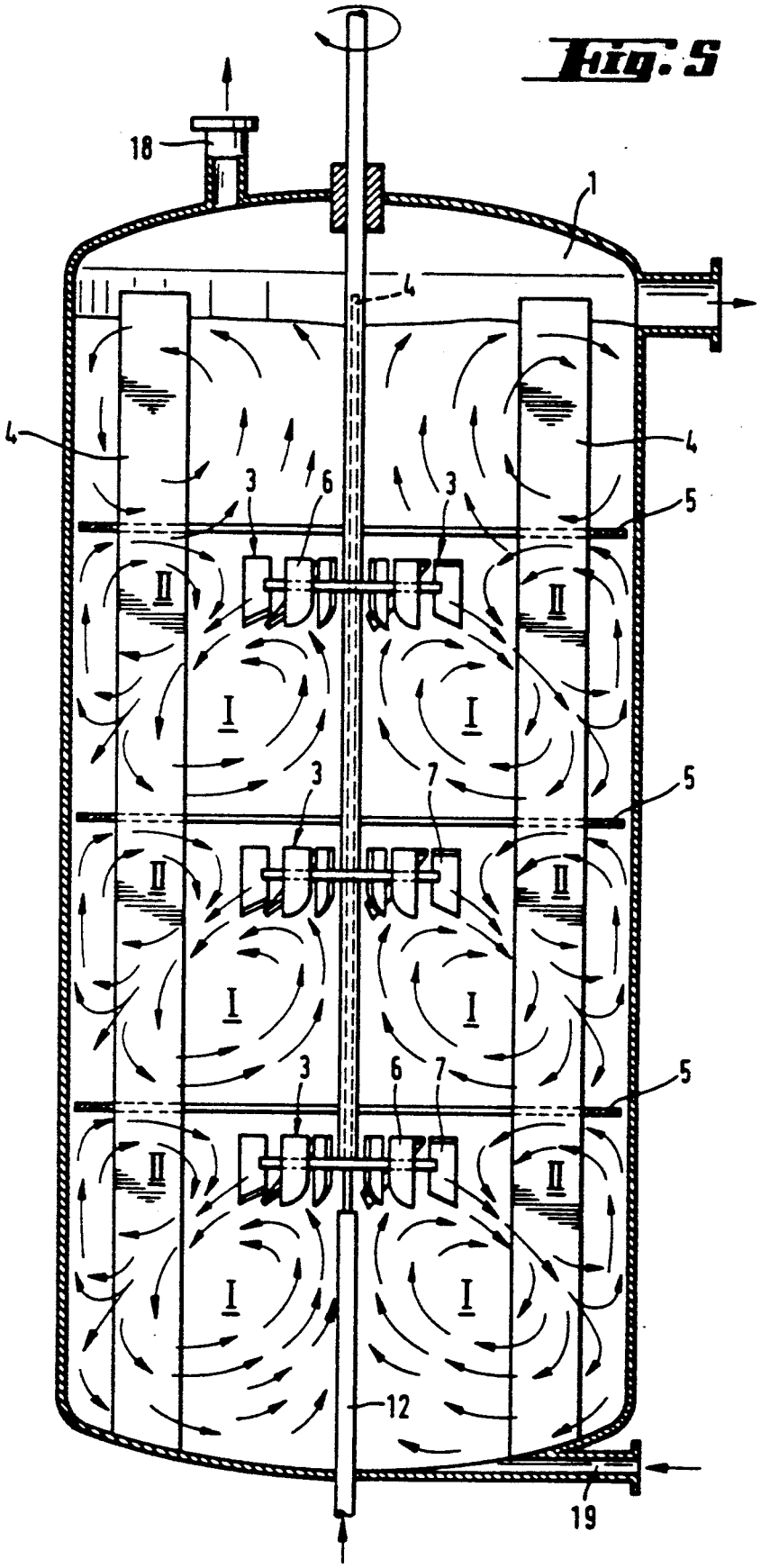
FIG. 5 is a vertical cross-section of a BTR reactor used as a fermentor.

FIG. 5 illustrates a reactor composed of several BTR units arranged on top of each other, wherein the gas delay is remarkably extended. This reactor is particularly well suited to be used as a fermentor in processes producing biomass. In the processes, a good and controlled degree of utilization is required for air or respectively oxygen, because the said sterilized gas to be used is considerable factor as for the expenses. A good gas dispersion and an adjustable discharge of the created carbon dioxide from the reactor increase the production capacity of biomass. The mixing intensity can be adjusted according to the mixing time of the produced biotissue.

In a multiple gas reactor, such as a fermentor, the gas is fed through the pipe 12 into the lowest BTR section, the structure whereof from the bottom up to the back-flow guiding member is the same as the one illustrated in the gas reactor of FIG. 4 or in the flotation cell of FIG. 2. Above the lowest BTR section there is at least one additional BTR section. Each additional section is provided with a gls mixer installed on the same axis, the distance of the said mixer from the back-flow guiding member of the lower section being equal to the distance of the mixer of the bottom section from the reactor bottom. The same uniform baffles rise from the reactor bottom up through all of the sections. Each section has its own back-flow guiding member, the distance whereof from the guiding member of the lower section is equal to the distance of the guiding member of the bottom section from the bottom. In the upper sections the mixer jet created by the mixer hits the cylinder surface at a height which is located in between the back-flow guiding member of the lower section and the height corresponding half of the mixer diameter. Consequently, in each BTR section there is formed a similar double loop pattern as is illustrated by arrows in FIG. 5. The drawing shows that the toroidal circulations of neighboring sections take place in the same direction and thus strengthen each other.

The suggested reactor construction is remarkably efficient for extending the delay of gas as well as liquid, solids or suspension fed into the bottom section and for preventing a straightforward penetration in the reactor, because the toroidal circulations arranged on top of each other are coupled in series and form separate reaction zones, and the mixing from one reaction zone to another takes place more slowly than in the toroidal circulation loops themselves.

The described reactor can be used in continuous operation, in which case it is advantageous to arrange all reactor inlets in the bottom section and outlets through a separate top section, the structure whereof may again be similar to the top part of the gas reactor illustrated in FIG. 4. When serving as a fermentor, the reactor is generally used in batch operation, in which case the feeding can be arranged in the lowest section and the discharge through the conduit 19. The gas is discharged through the conduit 18 through the top part of the reactor.

The basic back-flow guiding member illustrated in FIG. 2 can be used in all of the reactors as such, but in some cases it is advisable to use an additional auxiliary guide 16.

We claim:

1. A method of mixing a solid and/or a gas phase with a liquid phase in a generally cylindrical reactor having a mixer member rotatable about a substantially vertical axis, comprising the steps of: feeding phases to be mixed into a mixing space of the reactor below the mixer member; rotating the mixer member to mix the phases intensively while causing the phases to flow in a double toroidal circulation path; allowing the mixed phases to move upwardly to a reactor zone above the mixer member and through the middle of and a ring-shaped, adjustably positioned back-flow guiding member; controlling the flow of the mixed phases in the reactor zone above the back-flow guiding member by adjusting the position of the back-flow guiding member; and discharging the mixed phases from the reactor.

2. The method of claim 1 including feeding liquid into the mixing space as a jet which hits the level of an inner wall surface of the reactor at a height which is between the reactor bottom and a height corresponding to half the diameter of the mixer member.

3. The method of claim 1 and including mixing the phases in several superposed double toroidal flows.

4. The method of claim 3 wherein the several double toroidal flows are separated from each other by back-flow guiding members.

5. The method of claim 1 and including feeding liquid into the mixing space as a jet which hits the level of an inner wall surface of the reactor between the back-flow member and a height corresponding to half the diameter of the mixer member.

6. The method of claim 1 and including feeding a gaseous phase into the mixing space through a vertical conduit below the mixer member.

* * * * *

UNITED STATES PATENT AND TRADEMARK OFFICE

CERTIFICATE OF CORRECTION

PATENT NO. : 5,240,327

DATED : August 31, 1993

INVENTOR(S) : Bror G. Nyman et al

It is certified that error appears in the above-identified patent and that said Letters Patent is hereby corrected as shown below:

Column 1, line 56: after "nique." delete "p" and begin a new paragraph with "Among the practical".

Column 3, line 11: "f normal" should read --of normal--.

Column 5, line 14: "so-called over" should read: --so-called low ball bottom, which form does not yet spread the bottom toroid over so--.

Column 6, line 16: "n the cell" should read: --on the cell--.

line 26: "principle is to dependent" should read: -- principle is not dependent--.

Column 7, line 15: "is considerable factor" should read: --is a considerable factor--.

line 41: "corresponding half of the" should read: --corresponding to half of the--.

Signed and Sealed this

Twenty-ninth Day of March, 1994

Bruce Lehman

*Attest:*

BRUCE LEHMAN

*Attesting Officer*

*Commissioner of Patents and Trademarks*